US006087991A

United States Patent [19]

Kustas

[11] Patent Number: 6,087,991

[45] Date of Patent: Jul. 11, 2000

[54] SEMICONDUCTOR ANTENNA ARRAY AND SOLAR ENERGY COLLECTION ARRAY ASSEMBLY FOR SPACECRAFT

[75] Inventor: Frank Kustas, Parker, Colo.

[73] Assignee: Lockheed Martin Corporation, Bethesda, Md.

[21] Appl. No.: 09/292,712

[22] Filed: Apr. 15, 1999

[51] Int. Cl.[7] ..... H01Q 1/38

[52] U.S. Cl. ..... 343/700 MS; 343/853; 343/DIG. 2; 244/158 R

[58] Field of Search ..... 343/700 MS, 701, 343/720, 878, 879, 844, 853, 893, 912, DIG. 2; 244/158 A, 158 R, 173; 250/492.1, 492.2; 342/157, 158; H01Q 21/00, 21/06, 1/38

[56] References Cited

U.S. PATENT DOCUMENTS

| | | | |
|---|---|---|---|
| 3,594,803 | 7/1971 | Gerald | 343/720 |
| 3,636,539 | 1/1972 | Gaddy | 340/210 |
| 3,933,323 | 1/1976 | Dudley et al. | 244/1 |
| 4,293,172 | 9/1992 | Lamberty et al. | 343/701 |
| 4,594,600 | 6/1986 | Arora | 346/160 |
| 4,638,111 | 1/1987 | Gay | 136/249 |
| 4,644,363 | 2/1987 | Horn et al. | 343/785 |
| 4,788,555 | 11/1988 | Schultz et al. | 343/840 |
| 4,846,425 | 7/1989 | Champetier | 244/158 R |
| 4,864,317 | 9/1989 | Sorko-Ram | 343/720 |
| 5,043,739 | 8/1991 | Logan et al. | 343/701 |
| 5,307,195 | 4/1994 | Nicole | 359/156 |
| 5,373,306 | 12/1994 | Amore et al. | 343/872 |
| 5,527,001 | 6/1996 | Stuart | 244/158 |
| 5,598,989 | 2/1997 | Ross et al. | 244/158 |
| 5,608,414 | 3/1997 | Amore | 343/700 |
| 5,641,135 | 6/1997 | Stuart et al. | 244/173 |
| 5,666,127 | 9/1997 | Kochiyama et al. | 343/583 |
| 5,835,058 | 11/1998 | Upton | 342/359 |

FOREIGN PATENT DOCUMENTS

| | | | |
|---|---|---|---|
| 0012244 | 1/1979 | Japan | 343/DIG. 2 |

OTHER PUBLICATIONS

R.N. Edwards, et al., "Investigation of photoconductive silicon as a reconfigurable antena", SPIE vol. 1918 Smart Sensing, Processing and Instrumentation (1993).

Solar Cell Array Design handbook, vol. 1, Chapter 3.1 Solar Cell Types, NASA–JPL, Oct. 1976, pp. 3.1–1 to 3.1–4.

*Primary Examiner*—Don Wong
*Assistant Examiner*—Tho Phan
*Attorney, Agent, or Firm*—Holme Roberts & Owen LLP

[57] ABSTRACT

A semiconductor array assembly comprises an antenna array portion including a plurality of photonically-activatable semiconductor elements. The array assembly may also include a solar energy collection array portion having a plurality of photovoltaic cells. The two arrays may be supportably positioned on opposing sides of a common support structure (e.g. a dielectric substrate). An activation arrangement is provided to transmit photonic energy from an external source, such as solar radiation from the sun, received on a back side of the assembly to photonically-activatable elements to increase their electrical conductivity and thereby activate them for transmission and/or reception of electromagnetic signals. The activation arrangement may also feed photonic energy from an internal photonic energy source, such as laser diodes, through optical fibers to activate the photonically-activatable elements. A method of operating a solar-activated, antenna assembly involves positioning an array of photonically-activatable elements to receive photonic solar energy. The photonic energy activates the antenna array elements for operation. As such, while photonic energy is being received, the array of photoconductive semiconductor elements may be operated for transmitting and/or receiving electromagnetic signals.

30 Claims, 4 Drawing Sheets

SEMICONDUCTOR ANTENNA ARRAY AND SOLAR ENERGY COLLECTION ARRAY ASSEMBLY FOR SPACECRAFT

FIELD OF THE INVENTION

The present invention relates to spacecraft subsystems for communications and power generation, and more particularly, to an assembly combining an array of photonically-activatable semiconductor antenna elements with an array of solar energy collection elements and a method of operating an optically activatable semiconductor antenna array.

BACKGROUND OF THE INVENTION

Spacecraft, such as satellites orbiting the earth, are comprised of several sub-systems. Such sub-systems may include assemblies for generating power and assemblies for communicating with ground stations and/or other spacecraft.

Spacecraft power generating sub-systems typically include one or more solar panels. For example, solar panels may be deployed on opposing sides of the main body of a spacecraft. The solar panels include photovoltaic elements that convert photonic energy (e.g. solar radiation) incident thereon to electrical energy. Electrical lines may connect the photovoltaic elements of the solar panels to other parts of the power generating sub-system, such as one or more storage batteries within the main body of the spacecraft. A portion of the electrical energy generated by the solar panels while they are exposed to solar radiation is may be stored in the batteries for later use in operating the spacecraft during times when there is not sufficient solar radiation incident on the panels for generating the electrical energy needed to operate the spacecraft.

Communications sub-systems typically include one or more antenna arrays each having a plurality of metallic antenna elements (e.g. Cu) for transmitting and/or receiving electromagnetic signals, such as radio frequency signals. These antenna arrays are typically connected by electromagnetic signal feed lines to a transmission/reception unit that is located within the main body of a spacecraft. Utilizing power from the power generating sub-system, the transmission/reception unit processes electromagnetic signals by the antenna elements and generates electromagnetic signals that are fed to the antenna elements for transmission. Given the metallic nature of the antenna array elements, known communications subsystems are often readily detectable during both periods of use and non-use.

Additionally, the solar panels of power generating subsystems and the antenna arrays of communication subsystems are separately constructed, supported and operated.

SUMMARY OF THE INVENTION

One object of the present invention is to provide an assembly and method which reduces the weight and/or volume of spacecraft communications and power generating sub-systems.

Another object of the present invention is to provide an assembly and method providing dual functionality with respect to electromagnetic signal transmission/reception and solar energy collection in the operation of spacecraft subsystems.

A further object of the present invention is to provide an assembly and method providing for transception of electromagnetic signals and power storage/generation by a spacecraft in a cost efficient manner with reduced part count and complexity.

Yet another aspect of the present invention is to satisfy one or more of the noted objectives in the manner that renders communication sub-system componentry less subject to detection when not in use (i.e. to yield enhanced stealth characteristics).

These and other objectives and advantages are achieved by various aspects of the present invention. According to one aspect, an inventive method is disclosed which employs photonically-activatable, semiconductor antenna assembly supportably interconnected to a spacecraft. More particularly, an array of photonically-activatable antenna elements (e.g. single crystal silicon Si or gallium arsenide GaAs elements) is interconnected to a spacecraft and positioned so as to receive photonic energy on a back side from an external radiation source (e.g. solar radiation). As photonic energy from the external source is received at the antenna assembly such energy is utilized to increase the electrical conductivity of the photoconductive semiconductor elements, thereby activating the photoconductive semiconductor elements for transmission/reception of electromagnetic signals on a front side. In the later regard, radio frequency transmission lines may be provided on the spacecraft to provide/deliver communication signals between the antenna and a signal transceiver/control system positioned on the spacecraft. By way of example, the assembly may be utilized on spacecraft in earth, wherein the assembly is positioned to receive photonic energy during a portion of the orbit from the sun to facilitate activation of the array.

According to a related aspect of the present invention, the above-noted antenna assembly may include at least one collector for receiving incident photonic energy and transmitting the photonic energy directly to the photoconductive semiconductor antenna elements. By way of example, the collector may simply comprise cut-out portions in a supportive layer (e.g. dielectric substrates) on which the antenna array elements are disposed. The cut-out may be positioned in corresponding aligned fashion with the antenna elements, where back side incident radiation from an external source may pass directly to the back side of the antenna array elements for activation. The collector may further comprise one or more glass tanks (e.g. shallow box-shaped, solid glass structures), positioned to extend across the cut-out portions, wherein incident radiation is collected, contained and passed to the antenna elements for activation. To enhance radiation collection, the external surfaces of the glass tank(s) are preferably treated to provide for the internal reflection of incident radiation, with the exception of the surface region facing the photonically-activated antenna elements. Such treatment may include polishing of the external glass surfaces and/or the application of a dielectric, mirror-like coating (e.g. alternating layers of titanium dioxide, silicon dioxide, and/or some other oxide).

In the later regard, the invention may provide for the filtering of radiation received from an external source, wherein the photonic energy transmitted to the photoconductive semiconductor elements is restricted to be within a predetermined wavelength range selected for enhanced activation of the photoconductive semiconductor elements. Such predetermined wavelength range is preferably selected to be just below the wavelength corresponding to the bandgap energy of the semiconductor material utilized in the photonically-activatable antenna elements. The filtering effect may be accomplished by applying one or more dielectric coating layers, as noted above, to at least the back side surface of the glass tank(s), wherein only solar radiation within the selected wavelength range will be contained within the glass tank(s) for activation of the antenna elements.

As noted above, the antenna assembly may be positioned so that an activation side faces an external photonic energy source, such as the sun, and an antenna side faces a signal direction, for example the earth. This arrangement provides for the efficient activation of the antenna elements by incident photonic energy and the efficient transmission/reception of electromagnetic signals away from the antenna assembly.

In another aspect of the present invention, a photonically-activated, semiconductor antenna assembly is provided that includes at least one array of photoconductive semiconductor elements, as noted above, and an activation means for activating the array. The photoconductive semiconductor elements are operable for transmitting and/or receiving electromagnetic signals when activated by photonic energy. The antenna assembly is mounted to a spacecraft and may include electromagnetic signal transmission means, such as radio-frequency (RF) lines, coupled to the antenna array for carrying electromagnetic signals between the photoconductive semiconductor elements and a signal transceiver/control system located within the spacecraft.

The activation means may include at least one collector (e.g. including one or more glass tank(s) as described above), positioned on a back side of the semiconductor antenna elements for collecting photonic energy and directing the collected photonic energy onto the photoconductive semiconductor elements. In this regard, the photonic energy may include solar radiation from an external source. Additionally and/or alternatively, the activation means may comprise an internal photonic energy source, such as one or more laser diode(s), that provides activating photonic energy at a selected mono-wavelength to the collector via, for example, optical fibers. The predetermined, mono-wavelength may be selected to be just below the wavelength corresponding to the bandgap energy for the semiconductor antenna elements.

In yet a further aspect of the present invention, a semiconductor array assembly is provided on a spacecraft, wherein the array includes a solar energy collection array for converting and thereby generating power, and an array of optically-activatable semiconductor antenna elements for communication signal transception. The solar energy collection array includes a plurality of photovoltaic cells that convert incident photonic energy from an external source, such as solar radiation from the sun, into electrical energy. In this regard, the antenna assembly may include power transmission means, such as electrical lines, coupled to the solar energy collection array for transmitting the converted power away from the photovoltaic cells to, for example, a battery storage system located on the spacecraft. An activation means, as described above, may also be included for activation of the semiconductor antenna array. In this arrangement, the internal photonic energy source for activating the antenna array may be powered by the converted battery storage system.

According to a related aspect of the present invention, the array assembly provided with an activation side and an antenna side, wherein the photovoltaic cells of the solar energy collection array are located on the activation side and the photoconductive semiconductor antenna elements are located on the antenna side. More particularly, the solar energy collector elements and antenna array elements may be advantageously mounted on opposing sides of a common support structure (e.g. a flexible layer of a dielectric material such as kapton). Preferably, the antenna elements and photovoltaic cells are positioned in offset relation in dedicated portions upon the common support structure, wherein the antenna elements and photovoltaic cells may be disposed in parallel rows. Of note, the photovoltaic cells may be fabricated from a photovoltaic material (e.g. polycrystalline or amorphous silicon) having a coefficient of thermal expansion that is essentially equal to the coefficient of thermal expansion of the photoconductive material from which the photoconductive semiconductor antenna elements are fabricated (e.g. single crystal silicon). Such selection of materials is of particular benefit when a common support structure is utilized. Additionally, in such an arrangement, the provision of separate glass tanks in one-to-one relation to the semiconductor antenna array elements is preferred so as to accommodate enhanced storage of the assembly (e.g. via folding of the assembly in an accordion-like manner).

These and other aspects and attendant advantages of the present invention should become apparent from a review of the following detailed description when taken in conjunction with the accompanying figures.

DETAILED DESCRIPTION

Figures 1, 1A:
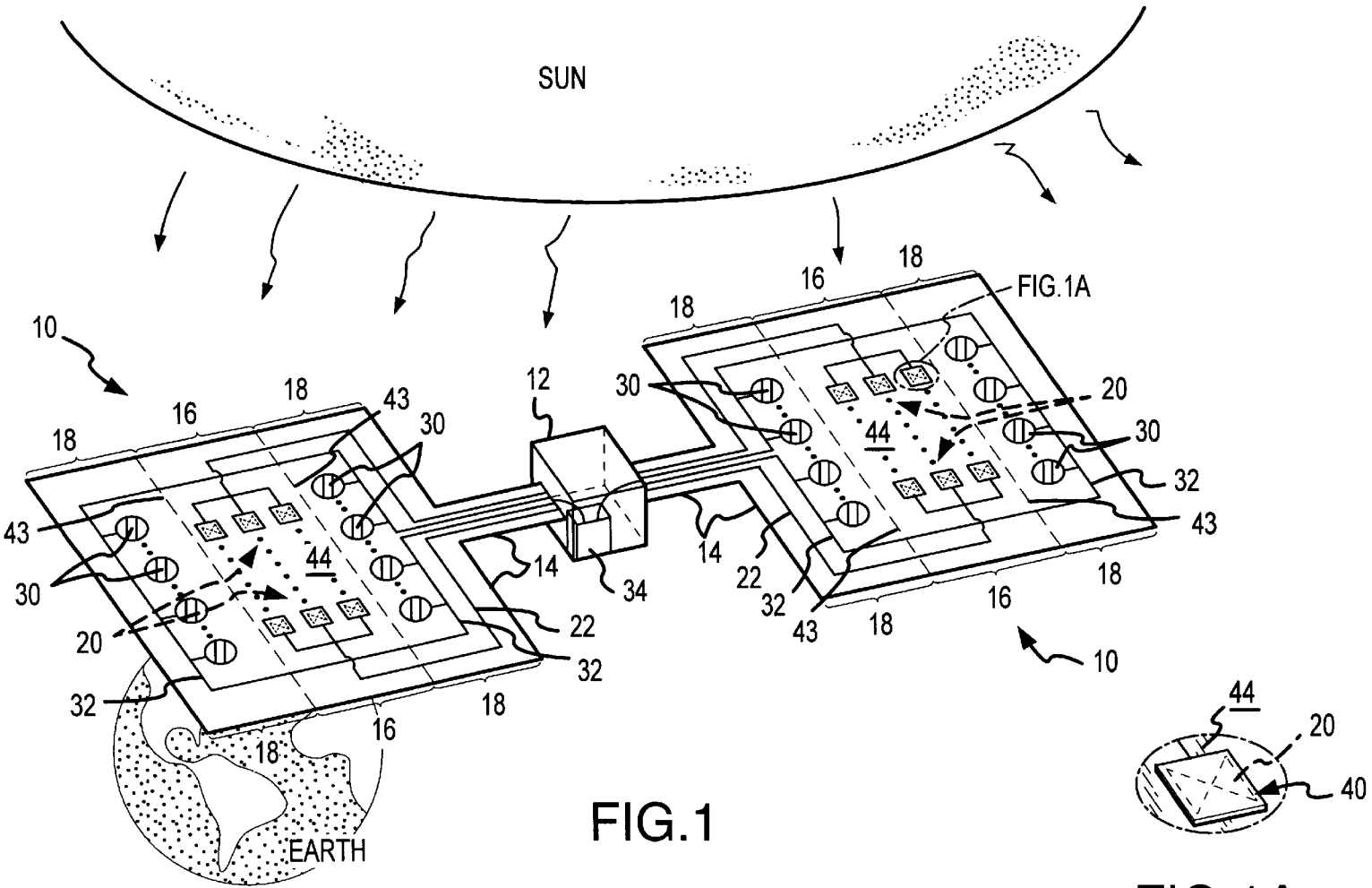
FIG. 1 illustrates a perspective view of one embodiment of a semiconductor array assembly in accordance with the present invention with a pair of the antenna arrays and photovoltaic arrays shown supportedly connected to opposing sides of a spacecraft in earth orbit.
Figure 2:
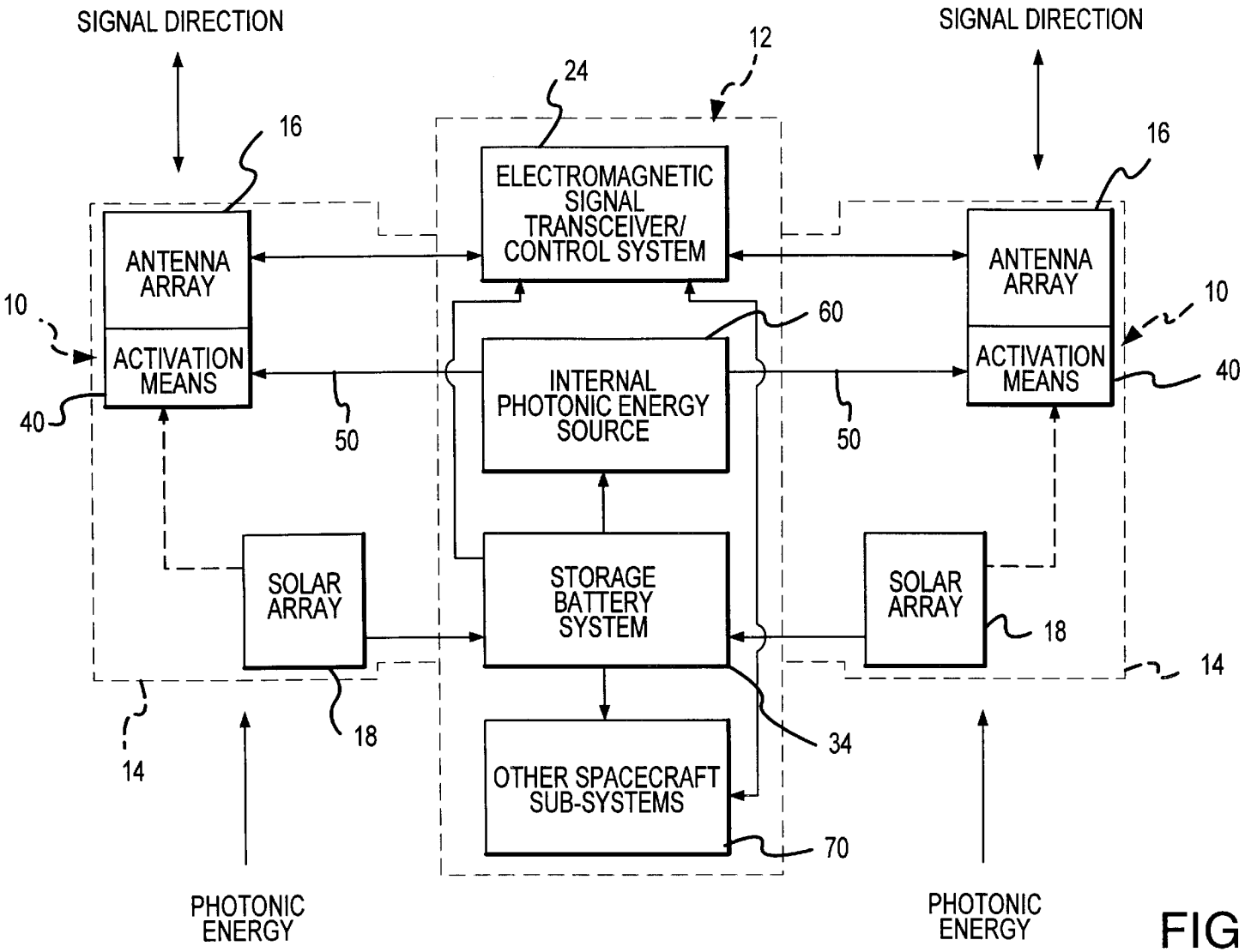
FIG. 2 illustrates a block system diagram of the embodiment illustrated in FIG. 1.

Referring now to FIGS. 1 and 2, an embodiment is illustrated comprising a pair of optically activated semiconductor array assemblies 10 supportably connected to opposing sides of a spacecraft 12 by opposing support structures 14. Each array assembly 10 generally comprises an antenna array portion 16 including a plurality of photoconductive semiconductor elements 20, a solar energy collection array portion 18 including a plurality of photovoltaic cells 30, and activation means 40 adapted to activate the antenna array portion 16 by increasing the electrical conductivity of the photoconductive semiconductor elements 20 via the delivery of photonic energy to the elements 20. Power transmission means, such as electrical lines 32, couple the photovoltaic cells 30 of the solar energy collection array portion 18 to a storage battery system 34 within the spacecraft 12.

As shown in FIG. 2, storage battery system 34 stores electrical energy generated by the solar array 18 when the photovoltaic cells 30 are exposed to sufficient photonic energy from an external source (e.g. the sun). Electromagnetic signal transmission means, such as radio-frequency (RF) feed lines 22, couple the photoconductive semiconductor elements 20 of the antenna array portion 16 with an electromagnetic signal transceiver/control system 24. The signal transceiver/control system 24 may receive power for operation from the storage battery system 34. The storage battery system 34 may also supply power to other spacecraft sub-systems 70 which may be coupled with the signal transceiver/control system 24.

Each assembly 10 has a front side (i.e. an antenna side) which may face a signal direction (e.g. a ground station on the earth) and a back side (i.e. an activation side) which may face an external photonic energy source (e.g. the sun). In FIG. 1, the spacecraft 12 is shown in earth orbit at a point wherein photonic energy from the sun is incident upon the back side of the array assemblies 10. However, it should be appreciated that the present invention generally contemplates spacecraft 12 that may not be in earth orbit, as well as the incidence of photonic energy on the back side of the array assemblies 10 from sources internal to the spacecraft 12.

When illuminated by sufficient photonic energy, the photoconductive semiconductor elements 20 of the antenna array portion 16 are operable to transmit and/or receive electromagnetic signals. In this regard, the photoconductive semiconductor elements 20 may comprise a material, such as single-crystal Si or GaAs, that exhibits a sufficient increase in electrical conductivity so as to act as a metallic, electromagnetic signal radiator/receiver when illuminated with photonic energy within in a predetermined wavelength range (e.g. <1.09 mm for Si, and <0.89 mm for GaAs). When not illuminated by such photonic energy, the photoconductive semiconductor elements 20 exhibit a non-metallic character, with a low radar cross section (RCS), which suggests stealth characteristics. The predetermined wavelength range for illumination may be selected to provide for efficient optical illumination, and may therefore preferably comprise wavelengths below the bandgap for the material comprising the semiconductor elements 20 For example, for Si elements 20 preferred wavelengths are less than about 1090 nm and for GaAs elements 20 the preferred wavelengths are less than about 890 nm. As will be appreciated, solar radiation provides photonic energy across a broad wavelength spectrum, including significant photonic energy within the preferred ranges noted above. For electrical efficiency purpose, it is noted that the optical absorption depth of the elements 20 should preferably be greater than the electrical skin depth of the elements.

The photoconductive semiconductor array elements 20 are disposed on the front side of the antenna array portion 16 of each array assembly 10 so that they may transmit and/or receive signals when the front side of each assembly 10 faces a signal direction. The photoconductive semiconductor elements 20 may be shaped in a variety of configurations, including a bow-tie configuration as is shown in the exploded view portion of FIG. 1.

The photovoltaic cells 30 are disposed on the back side of the photovoltaic array portion 18 of each array assembly 10 so that they may receive photonic energy from an external source. The photovoltaic cells may comprise a photovoltaic material such as polycrystalline or amorphous Si. It should be noted that the semiconductor elements 20 of the antenna array portion 16 and the semiconductor cells 30 of the photovoltaic array portion 18 may be supportably disposed on opposing sides of a common support layer 44 comprising support structure 14 to reduce space and componentry requirements. Such support layer may comprise a flexible, dielectric substrate such as kapton. In this regard, kapton substrates are available which comprise a dielectric layer and a metalized surface, wherein the metalized surface can be readily etched away to define the desired feed lines 32.

As shown in FIG. 1, the semiconductor elements 20 and semiconductor cells 30 may be disposed in offset relation on the common support structure 14, (e.g. within their respective array portions 16 and 18). Further, as shown in FIG. 1, the semiconductor elements 20 and semiconductor cells 30 may be oriented in parallel rows. Such a configuration facilitates storage considerations when a flexible support substrate 44 is utilized. That is, the support substrate 44 may be provided in a manner that allows the substrate to be folded in an accordion-like manner with the fold lines 43 positioned between adjacent rows of the semiconductor elements 20 and semiconductor cells 30.

In order to reduce the possibility of thermal stress-induced warpage of the assemblies 10, the photovoltaic cells 30 and the photoconductive semiconductor elements 20 may be comprised of photovoltaic and photoconductive materials, respectively, having essentially equal thermal expansive and conductive properties. For such purposes and by way of example, the photovoltaic cells 30 may comprise polycrystalline or amorphous Si and photoconductive semiconductor elements 20 may comprise single crystal Si.

The activation means 40 noted above is preferably disposed on the back side of photoconductive semiconductor elements 20. The activation means 40 may receive incident photonic energy from an external source (e.g. the sun) and transmit the photonic energy to the photoconductive semiconductor elements 20 to activate the photoconductive semiconductor elements 20 for signal transception. The activation means 40 may also be provided to receive photonic energy from an internal photonic energy source 60 (e.g. one or more laser diode(s)) located within the assemblies 10 on support structures 14 or within the spacecraft 12. Preferably, the internal photonic energy source 60 will deliver internally generated mono-wavelength photonic energy to activate the photoconductive semiconductor elements 20, wherein the selected wavelength is below the bandgap of the material comprising elements 20 and is otherwise selected for both optical illumination and electrical efficiency. Optical fiber(s) 50 may be utilized to transport and deliver the internal photonic energy to the elements 20 when a laser diode is utilized. The internal photonic energy source 60 may receive the power needed for generating photonic energy from the storage battery system 34.

Figure 3A:
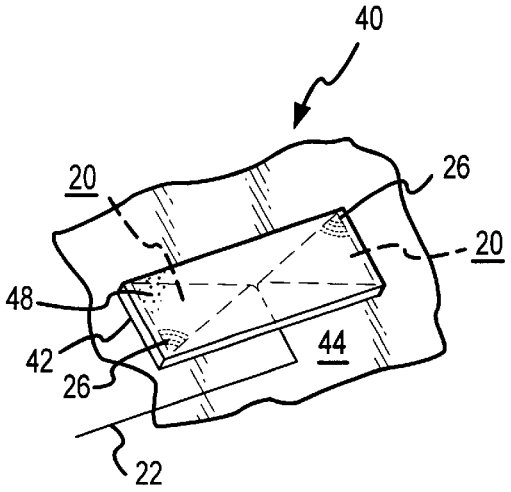
FIGS. 3A–3B illustrate two embodiments of activation means of an array assembly employing back side illumination from an external photonic energy source for activating photoconductive semiconductor elements of an antenna array.
Figure 3B:
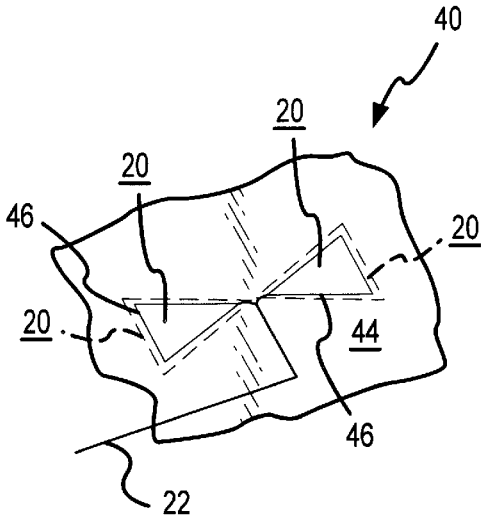

Referring now to FIGS. 3A and 3B, two embodiments of activation means 40 for activating the photoconductive semiconductor elements 20 of the antenna array portion 16 are shown. Both of these embodiments may utilize back side illumination from an external photonic energy source, such as solar radiation from the sun, to activate photoconductive semiconductor elements 20 for transmission and/or reception of electromagnetic communication signals.

The activation means 40 shown in FIG. 3A includes a glass tank 42 disposed on a back side (i.e. the side facing the external photonic energy source) of a photoconductive semiconductor element 20. The glass tank 42 may be of a solid glass construction having a flattened, box-like configuration. For radiation trapping and containment, (i.e. collection) the glass tank may have polished faces to yield high internal reflection. The lone exception is a region of the face which opposes the semiconductor element 20. In fact, such region may be slightly roughened to enhance illumination/activation of the element 20. It should be appreciated that a single large glass tank 42 may be provided on the back side of the multiple photoconductive semiconductor elements 20 in the antenna array portion 16. More preferably, separate glass tanks 42 will be disposed in one-to-one relation on the back side of each photoconductive semiconductor element 20 of the antenna array portion 16 as is depicted in FIG. 3A. The provision of separate glass tanks 42 behind each element 20 (e.g. each set of bowtie elements) facilitates folding of the array assemblies 10 into a small stowed volume, as otherwise noted above.

In the embodiment of FIG. 3A, the photoconductive semiconductor clement 20 is adhered directly on a front face (i.e. the signal facing side) of the glass tank 42 with an optical adhesive 26 having a refractive index that facilitates absorption of photonic energy into the back side of the photoconductive semiconductor element 20 when the back side of the antenna assembly 10 faces an external photonic energy source (e.g. the sun). By way of example, optical adhesive may be selected to provide a refractive index of at least about 1.47. The glass tank 42 may be peripherally mounted to a dielectric substrate 44 comprising the support structure 14, wherein a cut-out window is provided through the substrate 44. In this arrangement, the glass tank 42 serves as a collection device for collecting illumination from the external photonic energy source and transmitting the collected illumination onto the back side of the photoconductive semiconductor element 20.

While the glass tank 42 of FIG. 3A can be used with an external photonic energy source, (e.g. the sun) it may also serve as a diffuser for photonic energy delivered from an internal source 60 such as laser diode/optical fiber assembly, as noted above. An internal photonic energy source may be desirable during periods/orbits where the external photonic energy source does not provide sufficient radiation on the backside of assemblies 10 to activate the antenna elements 20.

The glass tank side 42 of activation means 40 shown in FIG. 3A may also be provided with a dielectric coating 48 that is applied on the back side of the glass tank 42. The purpose of the dielectric coating 48 is to restrict illumination of the photoconductive semiconductor element 20 (e.g. from an external photonic source such as the sun) to photonic energy within a particular wavelength range. In this regard, the dielectric coating may be chosen to restrict the photonic energy transmitted by the glass tank 42 to a wavelength range below the bandgap for the material comprising the photoconductive semiconductor element 20 (e.g., <1090 nm for Si and <890 nm for GaAs).

As is shown in FIG. 3B, instead of including a glass tank 42, the activation means 40 may simply include a cut-out portion 46 in dielectric substrate 44. The cut-out portion 46 is configured to match the geometry of an opposing photoconductive semiconductor element 20. In the FIG. 3B embodiment, the perimeter of the cut-out portion 46 is provided to be slightly smaller than the perimeter of the photoconductive semiconductor element 20 so that the photoconductive semiconductor element 20 can be adhered about its periphery to a signal facing side of the dielectric substrate 44 with an adhesive bead. The cut-out portion 46 of the dielectric substrate 44 permits transmission of illumination from an external photonic energy source (e.g the sun), to pass directly therethrough to the back side of the photoconductive semiconductor element 20 when the back side of the antenna assembly 10 faces the external photonic energy source. In a related arrangement, the cut-out portion 46 may be advantageously limited to an outline region, or strips, corresponding with the edges and feed points of the photoconductive semiconductor element 20 (e.g. for a bowtie semiconductor element configuration the cut-out region would be X-shaped). Such an arrangement may yield enhanced efficiency.

As noted, the assemblies described above may employ back side illumination from an external photonic energy source in order to activate photoconductive semiconductor elements 20 to summarize such operations, an assembly 10 may positioned so that the back side thereof faces the external photonic energy source, such as the sun. The front side is correspondingly positioned to face in a signal direction, such as towards the earth. The glass tanks 42 and/or cut-out portions 46 of the activation means 40 serve as devices for collecting, containing and/or simply passing photonic energy received on the back side of the antenna assembly 10 to the photoconductive semiconductor elements 20. The transmitted photonic energy illuminates and thereby activates the photoconductive semiconductor elements 20 for transmission and/or reception of electromagnetic signals. While photonic energy is being received on the back side of the antenna assembly 10, the antenna array portion 16 may be operated for transmission and/or reception of electromagnetic signals by directing electromagnetic signals from the signal transceiver 24 through the RF feed lines 22 to the activated photoconductive semiconductor elements 20 and/or directing electromagnetic signals through the RF feed lines 22 received by the activated photoconductive semiconductor elements 20 to the signal transceiver 24.

As noted above, the antenna assembly 10 may not always be positionable such that activation means 40 such as those shown in FIGS. 3A and 3B face an external photonic energy source that provides sufficient photonic energy on the back side of the antenna assembly 10 for activating the photoconductive semiconductor elements 20. For example, the back side of the antenna assembly 10 may not face the sun during some portion of the spacecrafti 12 orbit, such as when the earth is between the satellite 12 and the sun. As such, activation means 40 employing photonic energy generated by the internal photonic energy source 60 may be utilized to activate the photoconductive semiconductor elements 20 (e.g. by providing all or a sufficient supplemental portion of the necessary photonic energy) to achieve activation.

Figure 4:
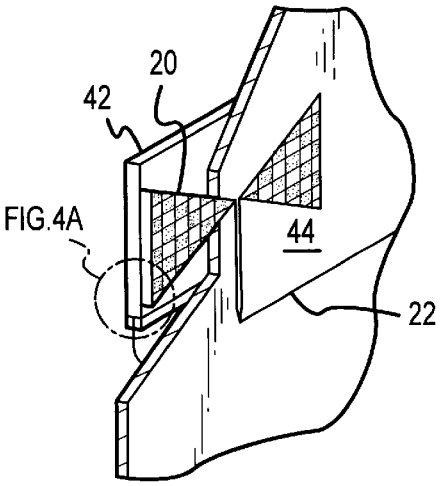
FIG. 4 illustrates another embodiment of activation means of an array assembly employing illumination generated by an internal photonic energy source for activating photoconductive semiconductor elements of an antenna array.
Figure 4A:
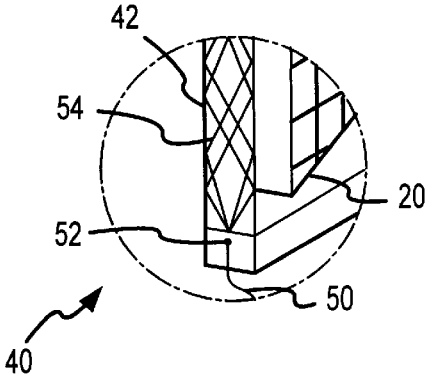

Referring now to FIG. 4, there is shown another embodiment of an activation means 40 of the antenna assembly 10 which employs photonic energy generated by an internal photonic energy source 60. The activation means 40 shown in FIG. 4 includes a glass tank 42 disposed on a back side (i.e. the side facing opposite the signal direction) of a photoconductive semiconductor element 20 and one or more optical fibers 50 interconnected to the glass tank 42. The optical fibers 50 may be interconnected to the side edge of the glass tank 42 by a dielectric fiber aligner 52. Photonic energy 54 generated by the internal photonic energy source 60 (e.g. a laser diode) is fed by the optical fibers 50 into the glass tank 42. The glass tank 42 diffuses the photonic energy 54 and transmits it to the photoconductive semiconductor elements 20 to activate the photoconductive semiconductor elements 20 for signal transmission and/or reception. The internal photonic energy source 60 in FIG. 4, preferably generates substantially mono-wavelength photonic energy 54 having a wavelength below the bandgap of the material comprising the photoconductive semiconductor elements 30 (e.g., <1090 nm for Si and <890 nm for GaAs).

To enhance light trapping and containment within the glass tank 42, faces and edges may be treated to provide for internal radiation reflection. For example, the back side face and the portion of the front side face that is not in opposing, face-to-face relation with element 20 may be polished so as to internally reflect radiation. Similarly, edges of the glass tank may be polished. Alternatively, a dielectric mirror-like coating, as described above, may be applied to the outside edges as well as the noted regions on the front and back faces. In this regard, for a box-shaped tank 42, all six surfaces may be polished and/or coated, except the front surface region opposing antenna element 20.

Figure 5:
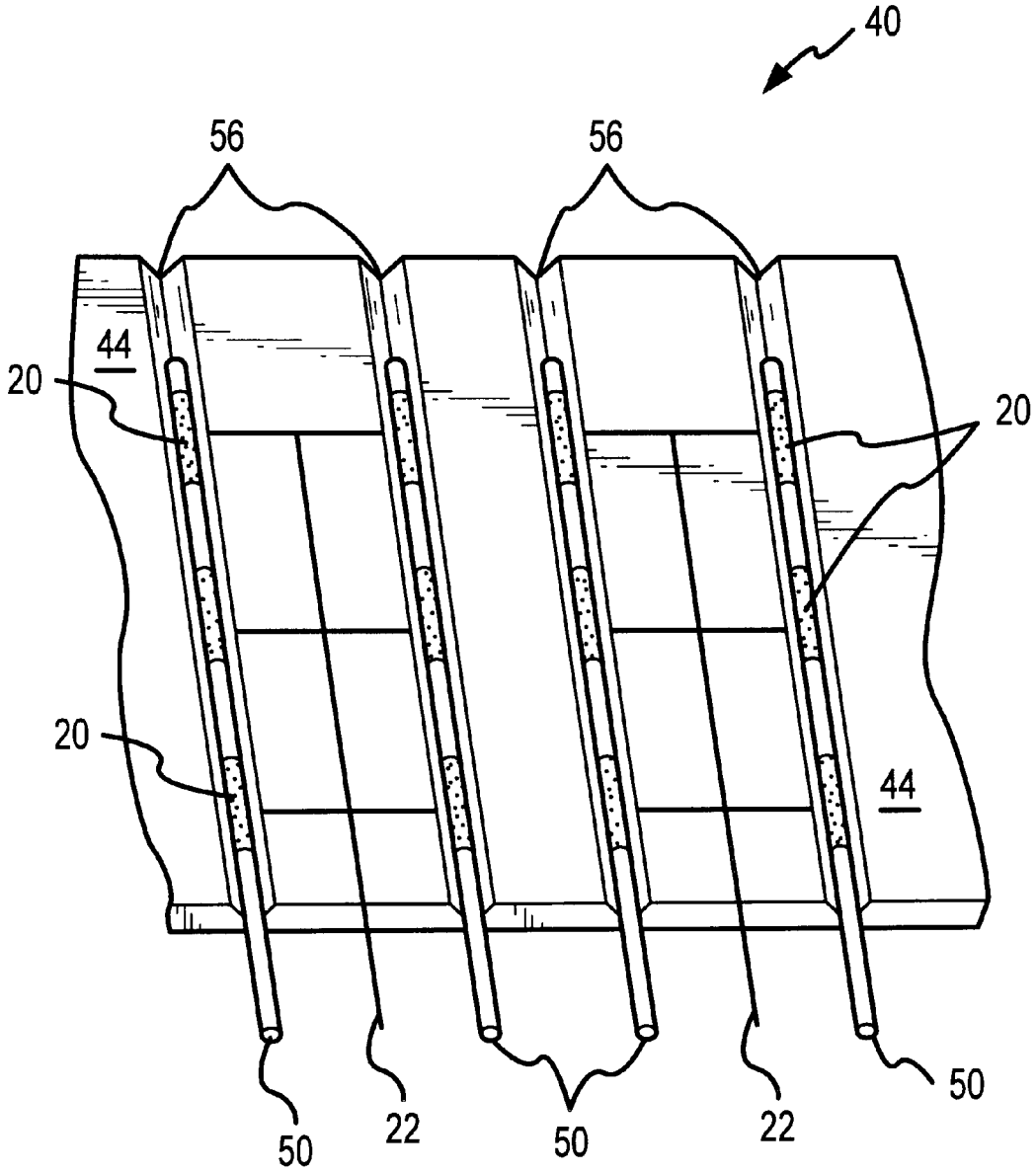
FIG. 5 illustrates another embodiment of activation means of an array assembly employing illumination generated by an internal photonic energy source for activating photoconductive semiconductor elements of an antenna array.

In FIG. 5, there is shown an additional embodiment of an activation means 40 of the antenna assembly 10 which also employs an internal photonic energy source 60 (e.g. one or more Kisev diodes). Photovoltaic cells (not shown in FIG. 5) may be disposed on a back side of a dielectric substrate 44 comprising the support structure 12. A plurality of grooves 56 are formed in the front side of the dielectric substrate section 44. Optical fibers 50 are adhesively bonded in the grooves 56. A portion of the cladding/buffer of the optical fibers 50 is stripped therefrom, and, where the cladding is stripped, photoconductive semiconductor elements 20 are adhered to the optical fibers 50 with an optical adhesive. In this instance, the photoconductive semiconductor elements 20 may again comprise single crystal Si. Photonic energy, preferably mono-wavelength below the bandgap of the Si photoconductive semiconductor elements 20 (e.g. <1090 nm for Si, or <890 nm for GaAs), is generated by the internal photonic energy source 60 and transmitted through the optical fibers 50. Upon intersection with a given stripped region of a fiber 50, photonic energy is allowed to escape, thereby illuminating the corresponding photoconductive semiconductor element 20. The optical fiber 50/photoconductive semiconductor element 20 configuration may be limited to a specific octave band of frequency operation, whereas the bowtie element configuration noted above can accommodate different size photoconductive semiconductor elements 20 which enables operation over several different frequency octave bands.

Although the same type of activation means 40 may be associated with each photoconductive semiconductor element 20 of the antenna array portion 16, an antenna assembly 10 having a combination of differently configured activation means 40 is also possible. For example, because the activation means 40 shown in FIGS. 3A and 4 both include a glass tank 42, these two alternative activation means 40 may both be included in combination. When the back side of the glass tank 42 faces an external photonic energy source, photonic energy from the external source transmitted by the glass tank activates the photoconductive semiconductor element 20, but when the back side of the glass tank 42 is not illuminated by sufficient external photonic energy, the internal photonic energy source 60 can supply photonic energy 54 that is fed by the optical fibers 50 to the glass tank 42 to illuminate the photoconductive semiconductor element 20.

Another example is a combination of the activation means 40 shown in FIGS. 3B and 5 since both of these activation means 40 include dielectric substrate sections 44. Some of the photoconductive semiconductor elements 20 of the antenna array portion 16 may be adhered to the front side of dielectric substrate 44. Cut-out portions 46, as shown in FIG. 3B, are formed in the dielectric substrate section 44 to allow back side illumination of these photoconductive semiconductor elements 20. The remaining photoconductive semiconductor elements 20 may be adhered to optical fibers 50 fitted in grooves 56 formed in the front side of the dielectric substrate section 44 as shown in FIG. 5. It should be appreciated that combinations of the different activation means 40 other than the examples described above are also possible.

The foregoing description of the present invention has been provided for purposes of illustration and description. This description is not intended to limit the invention and various modalities thereof. Variations, embodiments and modifications may be apparent to those skilled in the art and are intended to be within the scope of the following claims.

What is claimed is:

1. A method for use of a photonically-activatable, semiconductor antenna array mounted on a spacecraft, comprising the steps of:

positioning said antenna array to receive photonic solar energy, wherein said antenna array includes a plurality of photonically-activatable, semiconductor elements;

receiving photonic solar energy on said antenna array, wherein said received solar photonic energy increases the electrical conductivity of and thereby activates said elements in said antenna array, said activated elements thereby being operable for at least one of transmitting and receiving electromagnetic signals; and operating said antenna array for at least one of transmitting and receiving electromagnetic signals during said step of receiving photonic solar energy.

2. A method as set forth in claim 1, further comprising:

collecting said photonic solar energy and passing said collected solar photonic energy to said elements.

3. A method as set forth in claim 2, said collecting step comprising:

containing said photonic solar energy within at least one collector positioned in face-to-face relation with said plurality of photonically-activatable elements.

4. A method as set forth in claim 3, said collecting step further comprising:

reflecting said photonic solar energy within said collector.

5. A method as set forth in claim 3, further comprising:

filtering said photonic solar energy, wherein photonic solar energy transmitted to said photoactivatable elements is within a predetermined wavelength range.

6. A method as set forth in claim 5, wherein said predetermined wavelength range is below a bandgap of a material comprising said photonically-activatable elements.

7. A method as set forth in claim 1, said antenna array being part of an assembly having an activation side and an opposing signal transmission/reception side, wherein during said positioning step said antenna assembly is positioned so that said activation side faces an external photonic solar energy source to receive photonic solar energy and said signal transmission/reception side faces a signal direction for at least one of transmitting electromagnetic signals away from said assembly in said signal direction and receiving electromagnetic signals traveling toward said assembly from said signal direction.

8. A method as set forth in claim 7, wherein said assembly further includes at least one collection device for collecting said photonic solar energy, and wherein said at least one collection device is located on said activation side and said photonically-activatable elements are located on said signal transmission/reception side of said assembly.

9. A method as set forth in claim 8, further comprising:

receiving photonic solar energy on an array of photovoltaic cells positioned on said activation side of said assembly, wherein said photovoltaic cells convert said photonic solar energy to electrical energy.

10. A method as set forth in claim 9, wherein said photonically-activatable elements and said photovoltaic cells are supportably located on opposing sides of a dielectric support layer interconnected to the spacecraft.

11. A semiconductor array assembly interconnected to a spacecraft, comprising:

a support structure interconnected to a spacecraft;

at least one array of photoconductive semiconductor elements mounted on said support structure, said photoconductive semiconductor elements being operable for at least one of transmitting and receiving electromagnetic signals upon being activated by photonic energy; and activation means, positioned in face-to-face relation with said photoconductive semiconductor on said support structure, for activating said at least one array by delivering photonic energy to said photoconductive semiconductor elements of said at least one array, said activation means including at least one collection device for collecting photonic energy and transmitting said collected photonic energy onto said photoconductive semiconductor elements.

12. A semiconductor array assembly as set forth in claim 11, wherein said activation means is coupled with an internal photonic energy source supportedly interconnected to the spacecraft for providing activating photonic energy having a selected wavelength range to said at least one collection device.

13. A semiconductor array assembly as set forth in claim 12, wherein said at least one collection device includes at least one glass tank having at least one reflective surface for concentrating said activating photonic energy onto at least one of said photoconductive semiconductor elements.

14. A semiconductor array assembly as set forth in claim 13, wherein said at least one glass tank comprises a plurality of treated surfaces, said treated surfaces being either polished or coated with a reflective material.

15. A semiconductor array assembly as set forth in claim 11, wherein said photoconductive semiconductor elements and said at least one collection device are disposed on opposing sides of said support structure, and wherein openings are provided through said support structure between said photoconductive semiconductor elements and said at least one collection device to provide for a direct interface therebetween.

16. A semiconductor array assembly as set forth in claim 15, wherein said photoconductive semiconductor elements are directly adhered to said at least one collection device.

17. A semiconductor array assembly as set forth in claim 15, wherein said at least collection device comprises a plurality of separate glass tanks provided in one-to-one relation with said photoconductive semiconductor elements, wherein each of said photoconductive semiconductor elements is directly adhered to a corresponding one of said glass tanks.

18. A semiconductor array assembly as set forth in claim 17, wherein said support structure comprises a dielectric substrate.

19. A semiconductor array assembly as set forth in claim 18, wherein said array of photoconductive semiconductor elements comprises a plurality of parallel rows, wherein said dielectric substrate is flexible, and wherein said assembly may be folded in an accordion-like fashion for storage.

20. A semiconductor array assembly as set forth in claim 17, wherein each of said glass tanks is optically interconnected to an internal photonic energy source supportedly interconnected to said spacecraft.

21. A semiconductor array assembly, comprising:

at least one antenna array mounted on a first side of a support layer, including a plurality of photoconductive semiconductor elements, said photoconductive semiconductor elements being operable for at least one of transmitting and receiving electromagnetic signals upon being activated by photonic energy;

activation means, mounted on a second side of said support layer, for activating said at least one antenna array by delivering photonic energy to said photoconductive semiconductor elements of said at least one array, said activation means including at least one collection device for collecting photonic energy and transmitting said collected photonic energy onto said photoconductive semiconductor elements; and at least one solar energy collection array, mounted on said second side of said support layer, for generating power from photonic energy receivable by said collection array, said collection array including a plurality of photovoltaic cells.

22. A semiconductor array assembly as set forth in claim 21, said array assembly having an activation side that is positionable to face an external photonic energy source to receive photonic energy and an antenna side that is positionable to face a signal direction, said signal direction being selectable for controlling said at least one of transmitting and receiving electromagnetic signals.

23. A semiconductor array assembly as set forth in claim 22, wherein said photovoltaic cells of said at least one solar energy collection array are mounted in axially offset relation to said photoconductive semiconductor elements.

24. A semiconductor array assembly as set forth in claim 23, wherein said photovoltaic cells are fabricated from a photovoltaic material having a first coefficient of thermal expansion and said photoconductive semiconductor elements are fabricated from a photoconductive material having a second coefficient of thermal expansion, said first and second coefficients of thermal expansion being substantially equal.

25. A semiconductor array assembly as set forth in claim 24, wherein said photovoltaic material comprises one of amorphous silicon and polycrystalline silicon, and wherein said photoconductive material comprises single cell silicon.

26. A semiconductor array assembly as set forth in claim 21, wherein said array assembly includes power transmission means, coupled to said at least one solar energy collection array, for transmitting said generated power away from each of said photovoltaic cells, and wherein said array assembly includes electromagnetic signal transmission means, coupled to said at least one antenna array, for delivering electromagnetic signals to said activated photoconductive semiconductor elements for transmission and for carrying electromagnetic signals received by said activated photoconductive semiconductor elements.

27. A semiconductor array assembly as set forth in claim 21, wherein said at least one collection device comprises at least one glass tank disposed in face-to-face relation with said plurality of photoconductive semiconductor elements.

28. A semiconductor array assembly as set forth in claim 27, wherein said at least one glass tank comprises a plurality of surfaces treated to internally reflect photonic energy.

29. A semiconductor array assembly as set forth in claim 27, wherein said glass tank is optically interconnected to an internal photonic energy source supportably mounted to said spacecraft, wherein said internal photonic energy source provides photonic energy for activating said antenna array.

30. A semiconductor array assembly as set forth in claim 29, wherein said activation means comprises a plurality of glass tanks disposed in one-to-one, direct contact relation to said plurality of photoconductive semiconductor elements.

* * * * *